US006692033B2

(12) United States Patent
Miller et al.

(10) Patent No.: US 6,692,033 B2
(45) Date of Patent: Feb. 17, 2004

(54) FLUORESCENT STRIPE WINDOW ENVELOPES

(75) Inventors: Christopher P. Miller, Alison Viejo, CA (US); Keith Bussell, Los Angeles, CA (US)

(73) Assignee: Stamps.com, Santa Monica, CA (US)

( * ) Notice: Subject to any disclaimer, the term of this patent is extended or adjusted under 35 U.S.C. 154(b) by 0 days.

(21) Appl. No.: 09/811,006

(22) Filed: Mar. 16, 2001

(65) Prior Publication Data

US 2001/0032871 A1 Oct. 25, 2001

Related U.S. Application Data

(60) Provisional application No. 60/197,798, filed on Apr. 14, 2000.

(51) Int. Cl.[7] ..... B42D 15/00

(52) U.S. Cl. ..... 283/116; 229/71; D19/3

(58) Field of Search ..... 283/116, 81; D19/3; 382/101, 184; 229/71

(56) References Cited

U.S. PATENT DOCUMENTS

| | | | | | |
|---|---|---|---|---|---|
| 14,993 | A | * | 6/1856 | Sneider | 128/834 |
| 1,714,349 | A | * | 5/1929 | Dahlke | 229/68.1 |
| D119,449 | S | * | 3/1940 | Davis | 283/116 |
| 3,652,830 | A | | 3/1972 | Kessler | 235/61.12 N |
| 4,736,441 | A | * | 4/1988 | Hirose et al. | 209/584 |
| 4,783,825 | A | * | 11/1988 | Hirose et al. | 209/584 |
| 5,122,967 | A | | 6/1992 | Gilham | 364/479 |
| 5,408,416 | A | | 4/1995 | Gilham | 364/464.02 |
| D380,007 | S | * | 6/1997 | Kara | D19/3 |
| 5,769,550 | A | * | 6/1998 | Brand et al. | 400/279 |
| 5,932,139 | A | * | 8/1999 | Oshima et al. | 252/301.16 |
| D451,952 | S | * | 12/2001 | Kara et al. | D19/3 |
| 6,424,954 | B1 | * | 7/2002 | Leon | 705/401 |
| 2001/0032871 | A1 | * | 3/2001 | Miller et al. | 229/71 |

OTHER PUBLICATIONS

Reference article, "Reference #3: Word for Windows 1.x: Printing Envelopes on the IBM 4019", http:support.microsoft.com/supprt/kb/articles/Q102/3/93/ASP; 6 pp.

* cited by examiner

*Primary Examiner*—Monica S. Carter
(74) *Attorney, Agent, or Firm*—Christie, Parker & Hale, LLP

(57) ABSTRACT

A fluorescent strip window envelope for use with PC postage printed inserts. The envelope has a front wall and a rear wall, a top edge, a bottom edge, a right edge and a left edge. The envelope has a postage indicia window formed in the front wall in an upper right hand region thereof. The envelope is sized to accommodate at least three tri-folded sheets of standard sized letter paper sheets or a standard business courtesy envelope as inserts such that when the insert is inserted into the envelope there is less than about a 5% skew of the insert relative to the envelope and to expose the postage indicia printed on the insert. The envelope is free of FIM marks, and in lieu thereof has fluorescent strips printed on the right side top edge and the upper right side edge of the envelope.

19 Claims, 19 Drawing Sheets

FLUORESCENT STRIPE WINDOW ENVELOPES

CROSS-REFERENCE TO RELATED APPLICATIONS

This application claims priority based upon provisional patent application No. 60/197,798, filed on Apr. 14, 2000.

BACKGROUND OF THE INVENTION

1. Field of the Invention

This invention is in the field of envelopes, and more particularly is directed to special purpose envelopes specifically adapted for use in PC postage.

2. Description of the Related Art

The United States Postal Service (USPS) has responded to recent technological developments in the telecommunication and computer field by developing its Information Based Indicia Program (IBIP.) The IBIP involves the development of new technology to produce new forms of postage. In so-called PC Postage, a user can purchase postage credit, and print the postage in the form of PC Postage onto a label or directly onto the mail piece. The PC Postage includes a human readable portion and a 2-dimensional barcode portion. The human readable portion includes the postage value, mail class, the date, and optionally a logo. The barcode portion is intended to help thwart fraud, and includes information about the mail piece including the destination ZIP code, the amount of postage applied, the date and time the postage was applied, and a digital signature so that the USPS can validate the authenticity of the postage.

In one preferred embodiment of PC Postage, a user will subscribe to a third party Internet postage provider, such as Stamps.com (of Santa Monica, Calif.), and by using postage software made available by the Internet postage provider, postage value can be downloaded to the user's computer. The user can then print the postage indicia, by an ordinary laser or ink jet printer, directly onto the mail piece itself (e.g. onto business envelopes), onto a label to be applied to the mail piece, or alternately on an insert that can be placed into window envelope and show through a window envelope. This postage software preferably works in conjunction with other software programs, such as word processing, accounting, database, and contact management software to allow a user to conveniently print out PC Postage at the same time that addressee and bar code information is printed (and in the case of envelope printing also the sender's return address.)

In order to permit the sophisticated mail handling and optical reading equipment at the USPS to properly interpret the PC Postage and addressee information, it is critical that the postage indicia be presented in a relatively precise location on a mailpiece. Indeed, the USPS has established strict guidelines directed to the margins, label sizes, and placement of the Postage Indicia, and the size, placement, and other characteristics of the POSTNET (POStal Numeric Encoding Technique) bar codes, and any facing identification mark (FIM) on mail pieces. These guidelines are contained in the Domestic Mail Manual (DMM) and Title 39, Code of Federal Register (CFR), Part 111, and USPS Publication No. 25 "Designing Letter Mail".

A facing identification mark (FIM) is a pattern of vertical bars printed in the upper right area of a mail piece, to the left of the indicia space for a stamp, metering or PC postage. A FIM pattern is essentially a nine-bit code consisting of bars and no-bar place holders (in which the bars corresponding to a binary 1 and no bars correspond to a binary 0.) FIM patterns serves two major purposes. They allow mailpieces that do not contain luminescent stamps or meter imprints (such as business reply mail and official government mail) to be faced (oriented) and canceled (postmarked) by USPS machinery. FIM patterns also permit business reply mail and courtesy reply mail to be separated from other letters and cards for direct processing by optical character readers (OCRs) or barcode sorters (BCSs). This helps in achieving faster processing times.

Under USPS regulations, there are strict regulations concerning the size and placement of the FIM pattern. The FIM pattern must be printed in a FIM clear zone, in which no other printing must appear. Under present USPS regulations, the FIM clear zone is a rectangular sized zone extending from downwardly 1.59 cm (0.625 inch) from the upper edge of the mail piece and is located between 7.62 cm (3 inches) and 4.45 cm (1.750 inches) from the right side edge. The FIM bars must be 1.58 cm±0.32 cm (0.625 inch±0.125 inch) high and 0.079 cm±0.020 cm (0.03125 inch±0.008 inch) wide. The rightmost bar of the FIM must be 5.08 cm±0.32 cm (2 inches±0.125 inch) from the right edge of the mail piece. The tops of the FIM bars must be no lower than 0.32 cm (0.125 inch) from the top of mail piece and the bottoms of the FIM bars should touch the bottom edge of the FIM clear zone but must not be more than 0.32 cm (0.125 inch) above or below that edge.

Currently, the USPS requires Internet postage customers to use envelopes that have a FIM mark or fluorescent stripes in order to easily determine the location of the indicium. This requirement creates problems for Internet postage providers who want to support window envelopes. For example, if an Internet postage provider wants to support window envelopes that have a plastic window on the top right hand corner of the envelope, then a rectangular or round window cannot be used for this purpose because it will cover the FIM mark and its FIM clear zone.

Others have attempted to develop solutions to overcome this problem. For example, the E-Stamp Corporation, of San Mateo, Calif. has a window envelop design, as shown in FIG. 1, (Prior Art.)

There are several shortcomings with E-Stamp window envelope design, including:

1. Since the E-Stamp envelope, sized at about 9.53 cm×22.07 cm (3.75 inches×8.6875 inches), is smaller than a normal size 9 business envelope 9.85 cm×22.56 cm (3.88 inches×8.88 inches), a consumer must fold standard U.S. letter sized sheets 21.59 cm×27.94 cm (8.5 inches×11 inches) papers exactly in thirds in order to fit the sheets into the E-stamp envelopes.
2. If the front page of the insert with the postage indicium has ink showing through and into the FIM clear zone, then the USPS will reject the mailpiece because Internet postage vendors are required to provide a system that is automation compatible. To be automation compatible, the system must leave the FIM clear zone free of ink.
3. Due to the small size of the E-Stamp envelope, a limited number of sheets (only one or two) will fit into the E-Stamp window envelopes. Attempts to insert more than two sheets causes difficulty.

Currently, under all of the USPS programs including the IBIP program, there is a maximum 5% skew requirement. This maximum skew requirement is intended to ensure that inserts are skewed less than 5% from the horizontal axis of the envelope to ensure that the indicium is properly displayed through the indicium window. See FIG. 2 (prior art.) Folding sheets into thirds can also introduce skew if the corners of the sheet being folded are not properly lined up. Although there are problems associated with the E-Stamp indicium-window envelopes, the noted E-Stamp design does comply with the 5% skew requirement imposed under the USPS since its undersized envelope is in compliance with the 5% skew requirement. The current size of the E-Stamp indicium-window envelope is 9.53 cm×22.07 cm (3.75 inches×8.6875 inches). This envelope is smaller than the standard size 10 envelope and smaller than the standard size 9 envelope. A standard size 10 envelope has an outer size of 10.48 cm×24.13 cm (4.125 inches×9.5 inches) and is very important for indicium window designs because size 10 envelopes are the most widely used envelopes by business users. By sizing its envelope to have the smaller size than an size 9 envelope, E-Stamp forces users to fold inserts into almost perfect thirds. This creates problems for the small business users who may not have paper-folding machines and who are therefore relegated to manually fold the inserts. Manually folding leaves much room for human errors, with the result that if the inserts are not folded into almost perfect thirds, users will not be able to put the inserts in the envelope properly.

There accordingly remains a need for window envelopes that are easily used with Internet postage, does not create skewing problems, allows a reasonable number of sheets to be placed therein, and which does not require extremely precise folding of inserts.

SUMMARY OF THE INVENTION

The inventor has designed a number of fluorescent stripe window envelopes that effectively solve the FIM clear zone and skewing problems identified above.

In the inventor's design, the FIM mark is entirely eliminated from the envelopes, and instead fluorescent stripes are printed on the top right hand corner and top of the right side edge. Users can thus gain additional flexibility in folding the insert such that the indicium is properly displayed through the plastic window that is located at the top right hand corner. This design completely solves the FIM clear zone problem, and users need not be concerned about the inserts shifting in the envelope and risk having the mail piece being rejected by the USPS. The fluorescent stripe on the top right hand corner assists automated processing equipment to detect the location of the indicium showing through the window.

Moreover, while any number of non-standard size envelopes can be developed, standard size 9 and 10 envelopes can be quite readily used, thereby saving the end user from having to have specially sized envelopes.

DETAILED DESCRIPTION OF THE INVENTION

Figure 1:
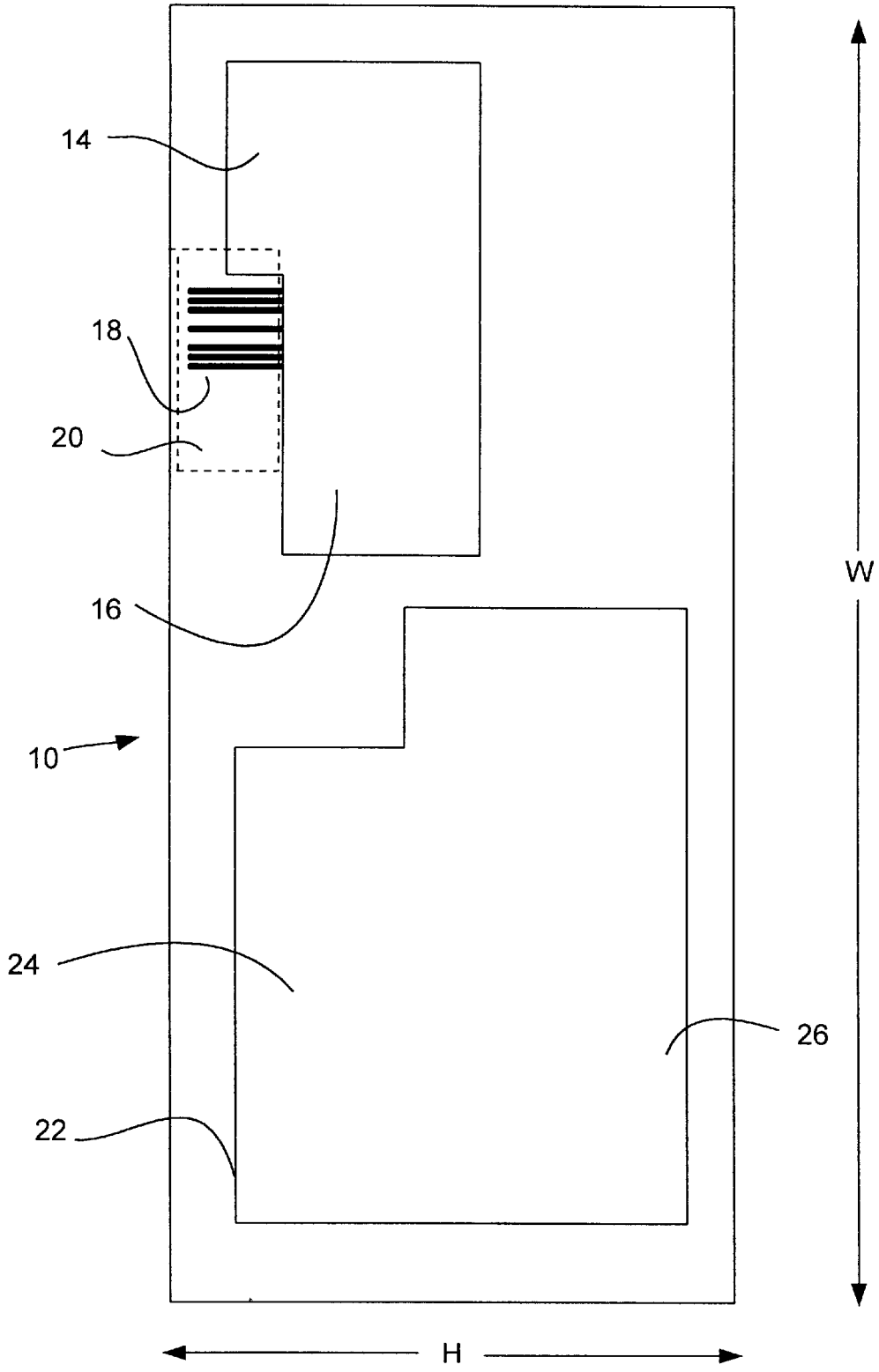
FIG. 1 (PRIOR ART)
FIG. 1 is a plan view of a prior art windowed envelope adapted for Internet postage.

Turning first to FIG. 1, there is shown an E-Stamp prior art windowed envelope 10 for indicia based mailing. The windowed envelope 10 has a generally "boot-shaped" indicia window 12 in an upper right hand corner of the envelope, with a smaller upper box region 14 and a larger lower box region 16. A FIM pattern 18 is printed in the FIM clear zone 20 (shown in dashed lines), and the smaller upper box region 14 partially impinges in the FIM clear zone 20. A combination addressee and sender window 22 is located at a left side of the envelope, and has an upper left smaller box portion 24 for the sender's address and a larger lower box portion 26 for the addressee information. A major problem with this design is that since its upper box region 14 impinges into the region of the FIM clear zone 20, if the insert slides into the FIM clear zone 20, the automated processing equipment may reject the mailpiece. Perhaps to help deal with this problem this window envelope is sized to have a height H and width W of 9.53 cm×22.07 cm (3.75 inches×8.6875 inches), which is smaller than a standard size 9 envelope, sized to be 9.85 cm×22.56 cm (3.88 inches×8.88 inches).

Figure 2:
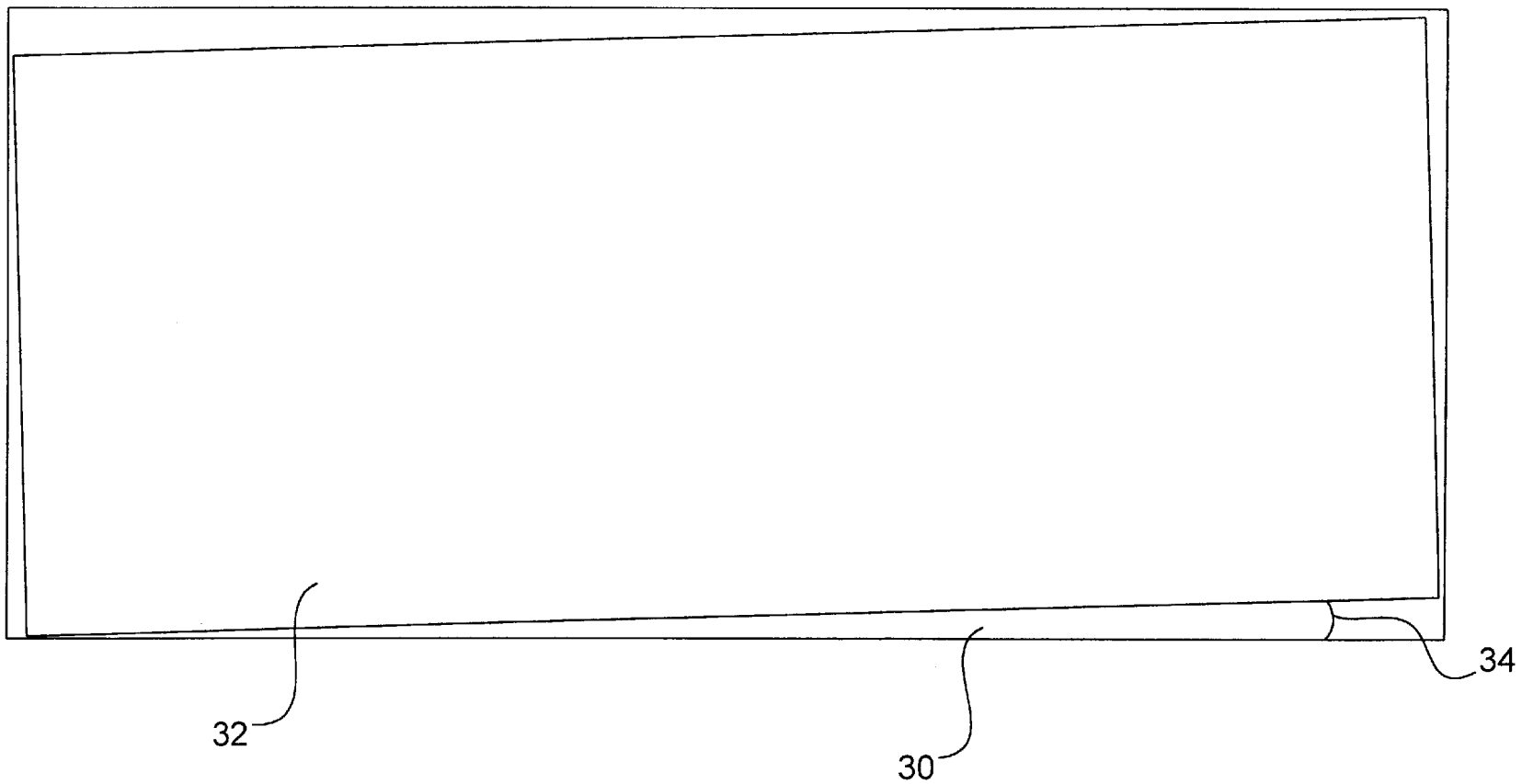
FIG. 2 PRIOR ART
FIG. 2 is a plan view showing an insert skewing in a generic envelope.

Turning to FIG. 2, there is shown an envelope 30 with an insert 32 placed therein. The skew 34 can be no more than 5%, which may explain the tight tolerances of the E-Stamps windowed envelope.

Figure 3:
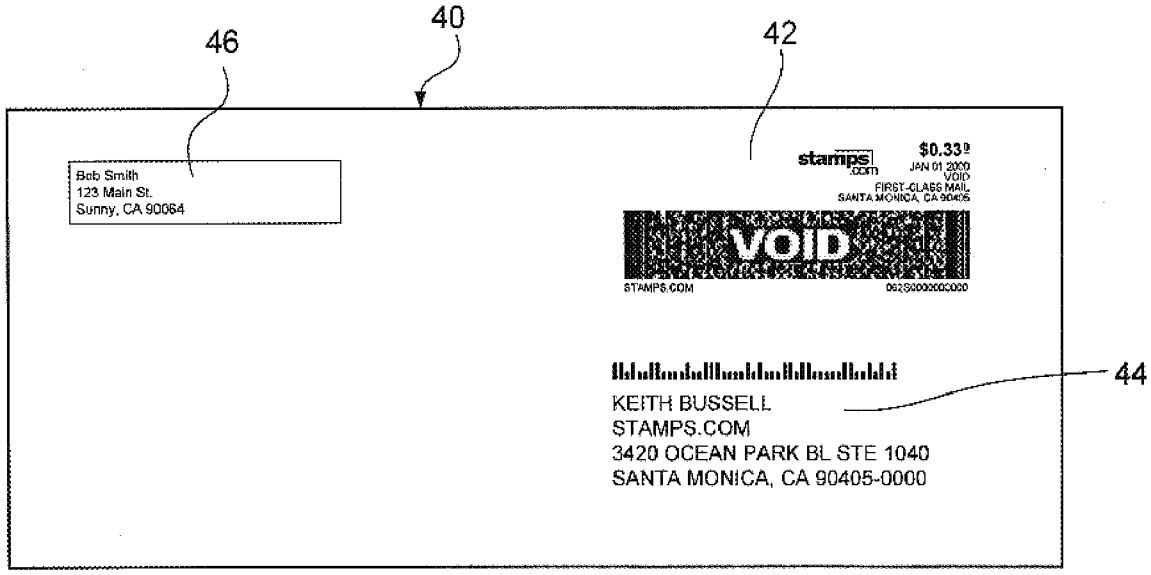
FIG. 3 is a plan view showing an insert for fluorescent windowed envelopes of the invention.

Referring to FIG. 3, there is shown an insert 40, which can comprise a sheet of standard U.S. letter sized sheet 21.59 cm×27.94 cm (8.5 inches×11 inches) paper folded into thirds, to assume a size of about 21.59 cm×9.31 cm (8.5 inches×3.67 inches.) The insert 40 is printed with postal indicia 42 in an upper right hand corner thereof, the addressee information 44 in a lower portion of the insert, and optionally with sender information 46 in an upper left hand corner of the insert. No FIM pattern is printed on the insert 40.

Figure 4:
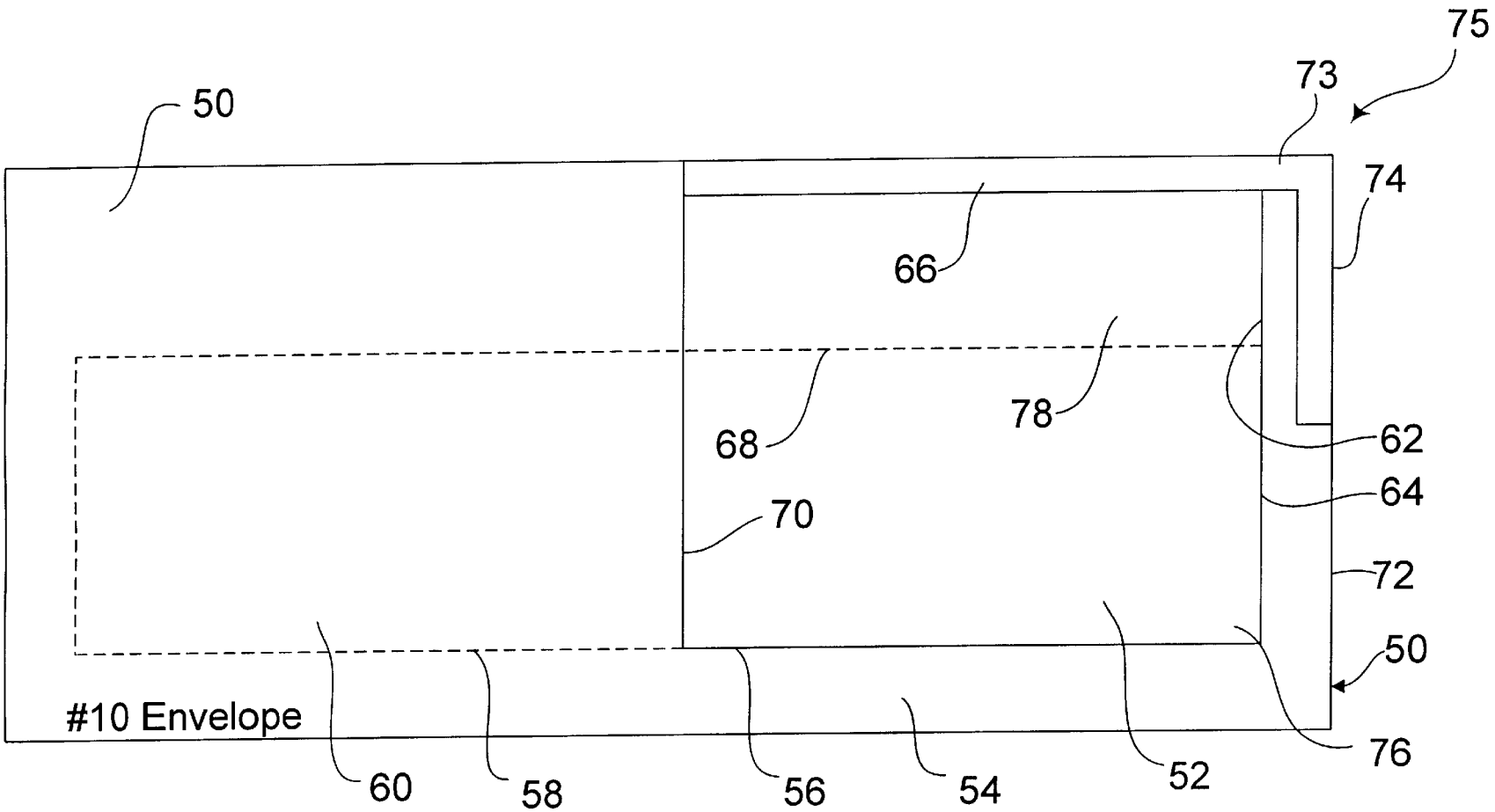
FIG. 4 is a plan view showing a first embodiment of an fluorescent stripe window envelope of the invention.

FIG. 4 is a plan view showing a first embodiment of the fluorescent stripe window envelope 50 of the invention. This envelope can be sized as a standard No. 10 business envelope, namely about 10.48 cm×24.13 cm (4.125 inches× 9.5 inches), and is sized to accommodate as much inserted materials as a standard size 10 envelope. The fluorescent stripe window envelope of FIG. 4 includes an oversized addressee/postage indicia window 52 on a right hand side 54 of the envelope. The addressee/postage indicia window 52 is preferably sized and located on the envelope 50 such that its lower edge 56 is about at or below a lower edge 58 of the addressee scanning region 60 (shown in phantom dashed lines), has a right edge 62 which is about at or to the right of a right edge 64 of the addressee scanning region 60, and has an upper edge 66 which extends well above an upper edge 68 of the addressee scanning region 60. The left hand edge 70 of the addressee/postage indicia window 52 extends to the left of the right hand edge 72 of the envelope to an extent necessary to provide sufficient area for the addressee information. In the embodiment of the fluorescent stripe window envelope 50 shown, the addressee/postage indicia window 52 is about 10.46 cm wide×8.26 cm high (4.12 inches×3.25 inches.) Solid fluorescent stripes 73 and 74 are printed only on an upper top right edge and upper right hand, respectively, of the envelope, where the Postage indicia window is located, which two fluorescent stripes 73 and 74 together form a mirror-image of a shaped stripe layout 75 with a top stripe 73 being at the upper right edge and the side stripe 74 being at the upper right hand side and serve as a replacement for an absent FIM pattern. The fluorescent stripes 73 and 74 are preferably about 0.635 cm (0.25 inch) wide, but other widths can be used as desired, so long as they are sufficiently wide to comply with postal service regulations. The solid fluorescent stripes 73 and 74 are shown as extending to the edges of the envelope, but could also be placed away form the edges of the envelope 50 if desired, and subject to postal service requirements. The addressee/postage indicia window 52 thus has a lower region 76 (for revealing addressee information, and an upper region 78 (for revealing Internet postal indicia.) The postal indicia need not, however, be completely revealed through the upper region 78 of the window 52 in order for the mailpiece to be processed.

Turning now to FIGS. 5 to 8, there is shown the insert 40 of FIG. 3 inserted into the fluorescent stripe window envelope 50 of FIG. 4, with the insert 40 variously shifted within the fluorescent stripe windowed envelope 50. The addressee scanning region 60 is shown in dashed lines and the perimeter of the insert 40 is shown in solid lines 78, with the mirror-image of an L-shaped layout 75 comprised of fluorescent stripes 73 and 74 shown in the upper right hand corner of the envelope.

Figure 5:
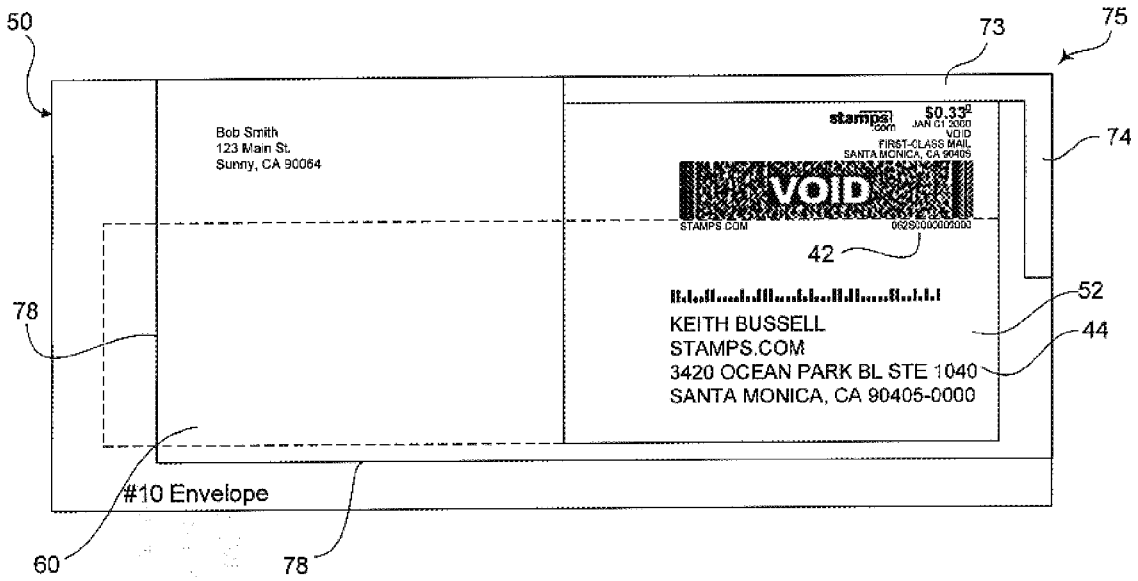
FIG. 5 is a plan view of the fluorescent windowed envelope of FIG. 4 with the insert of FIG. 3 placed therein and shifted to an upper right corner of the fluorescent windowed envelope.

FIG. 5 is a plan view of the fluorescent stripe windowed envelope of FIG. 4 with the insert of FIG. 3 placed therein and shifted to an upper right corner of the fluorescent windowed envelope 50.

Figure 6:
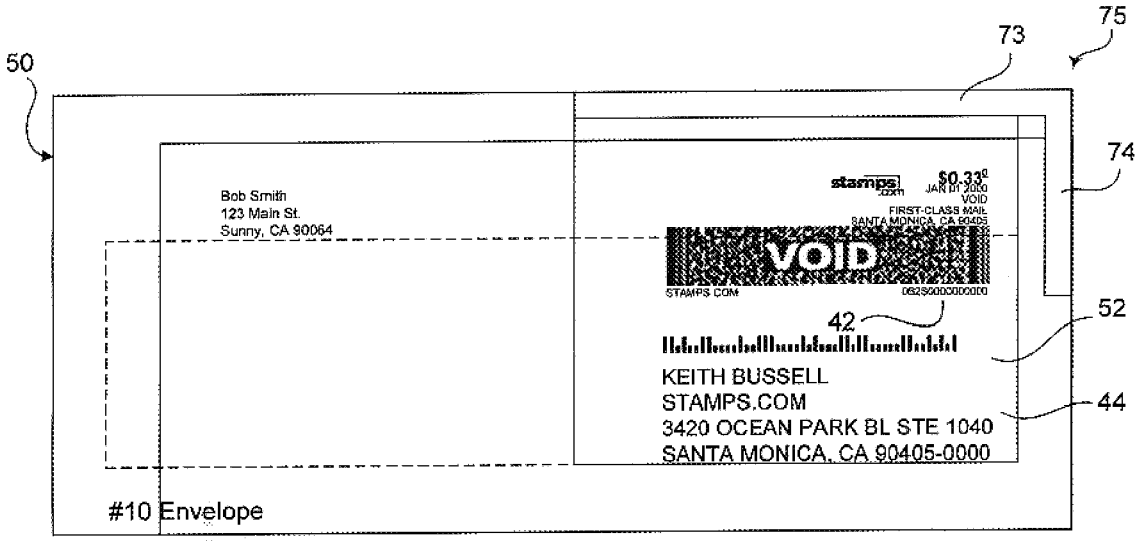
FIG. 6 is a plan view of the fluorescent windowed envelope of FIG. 4 with the insert of FIG. 3 placed therein and shifted to a lower right corner of the fluorescent windowed envelope.

FIG. 6 is a plan view of the fluorescent windowed envelope 50 with the insert 40 placed therein and shifted to a lower right corner of the fluorescent windowed envelope 50.

Figure 7:
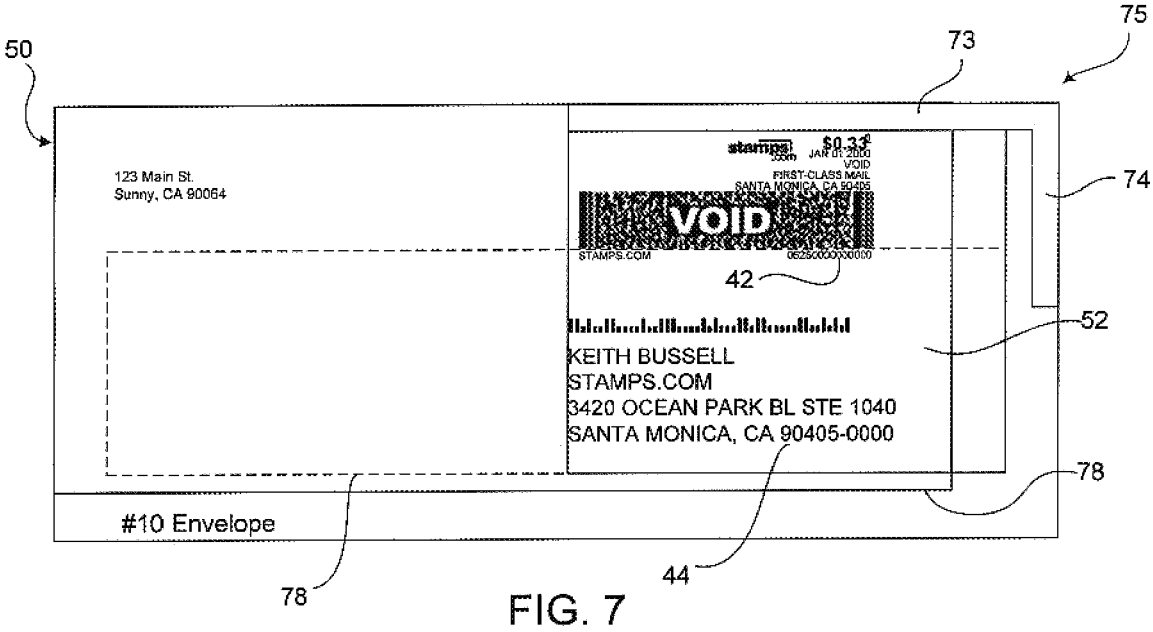
FIG. 7 is a plan view of the fluorescent windowed envelope of FIG. 4 with the insert of FIG. 3 placed therein and shifted to an upper left corner of the fluorescent windowed envelope.

FIG. 7 is a plan view of the fluorescent stripe windowed envelope 50 with the insert 40 placed therein and shifted to an upper left corner of the fluorescent windowed envelope 50.

Figure 8:
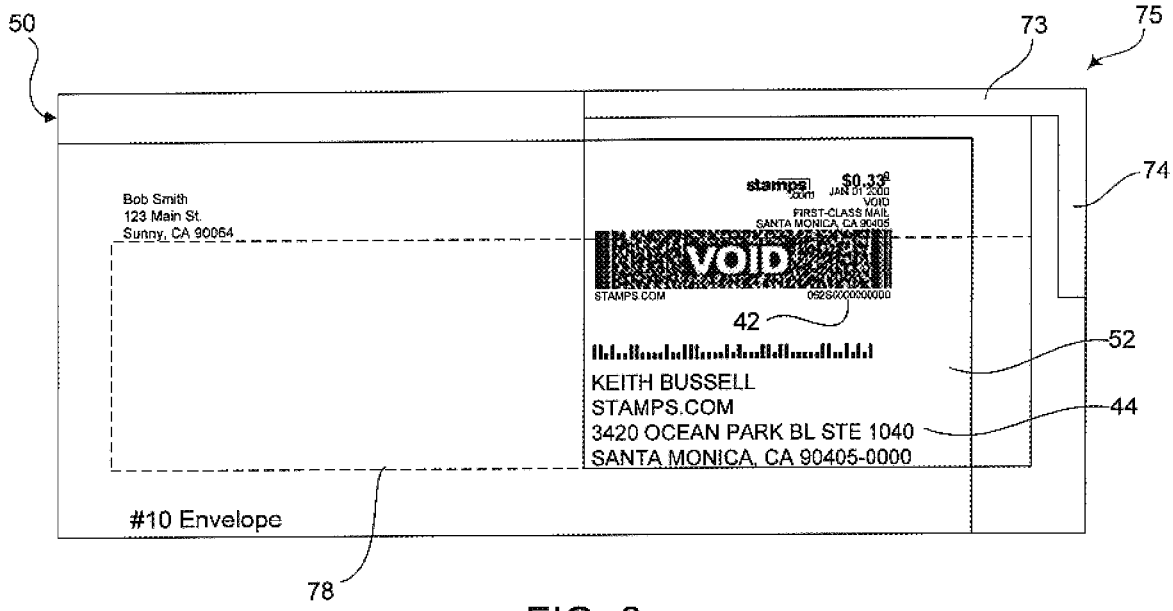
FIG. 8 is a plan view of the fluorescent windowed envelope of FIG. 4 with the insert of FIG. 3 placed therein and shifted to a lower left corner of the fluorescent windowed envelope.

FIG. 8 is a plan view of the fluorescent stripe windowed envelope 50 with the insert 50 placed therein and shifted to a lower left corner of the fluorescent windowed envelope 50.

As can be seen, even when the insert 40 is shifted within the envelope 50 to the maximum extent allowed, the address information 44 and Postage indicia 42 will always fully revealed through the addressee/postage indicia window 52.

Figure 9:
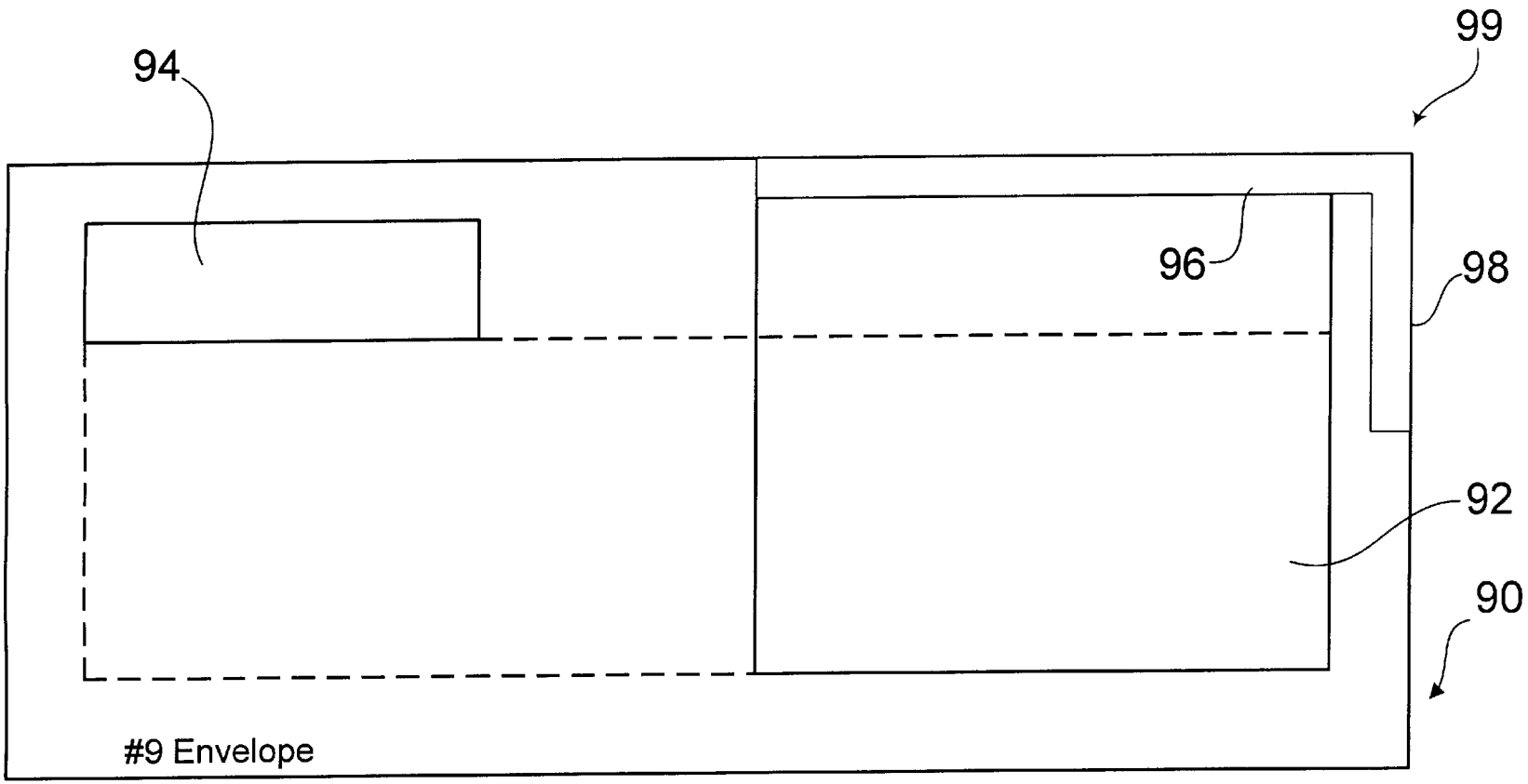
FIG. 9 is a plan view showing a second embodiment of an fluorescent stripe window envelope of the invention.

Turning to FIG. 9 there is shown a plan view of a second embodiment of an fluorescent stripe window envelope 80 of the invention. This envelope is quite similar to the fluorescent stripe window envelope 50 of FIG. 4, except that in addition to an addressee/postage indicia window 92 on a right hand side of the envelope 92, it also includes a smaller sender display window 94 on an upper left hand side of the envelope. Also, as shown, instead of being a size 10 envelope, it is shown as sized as a size 9 envelope (often used as a business courtesy envelope), and sized at 9.85 cm high×22.56 cm wide (3.88 inches×8.88 inches). The width of addressee/postage indicia window 92 is shown as being about 9.22 cm wide and about 7.62 cm high (3.63 inches× 3.00 inches), but the dimensions can be varied as needed. The sender display window 94 is shown as about 6.35 cm wide×1.91 cm high (6.35 inches×1.91 inches), but can be varied as well. As with the first embodiment, the fluorescent stripe window envelope 80 has solid fluorescent stripes 96 and 98 printed only on an upper top right edge and upper right hand, respectively, of the envelope, which two fluorescent stripes 96 and 98 together form a mirror-image of an L-shaped stripe layout 99 with the top stripe 96 being located at the upper right edge and the side stripe 98 being at the upper right hand side where the postage indicia window is located, and serve as a replacement for an absent FIM pattern. The fluorescent stripes 96 and 98 are preferably about 0.635 cm (0.25 inch) wide, but other widths can be used as desired, so long as they are sufficiently wide to comply with postal service regulations. The fluorescent stripes 96 and 98 and the L-shaped stripe layout 99 are shown as extending to the edges of the envelope, but could also be placed away form the edges of the envelope 90 is desired, and subject to postal service requirements.

Turning now to FIGS. 10 to 13, there is shown the insert 40 of FIG. 3 inserted into the fluorescent stripe window envelope 90 of FIG. 9, with the insert 40 variously shifted within the fluorescent stripe windowed envelope 90. The mirror-image of an L-shaped layout 99 comprised of fluorescent stripes 96 and 98 shown in the upper right hand corner of the envelope.

Figure 10:
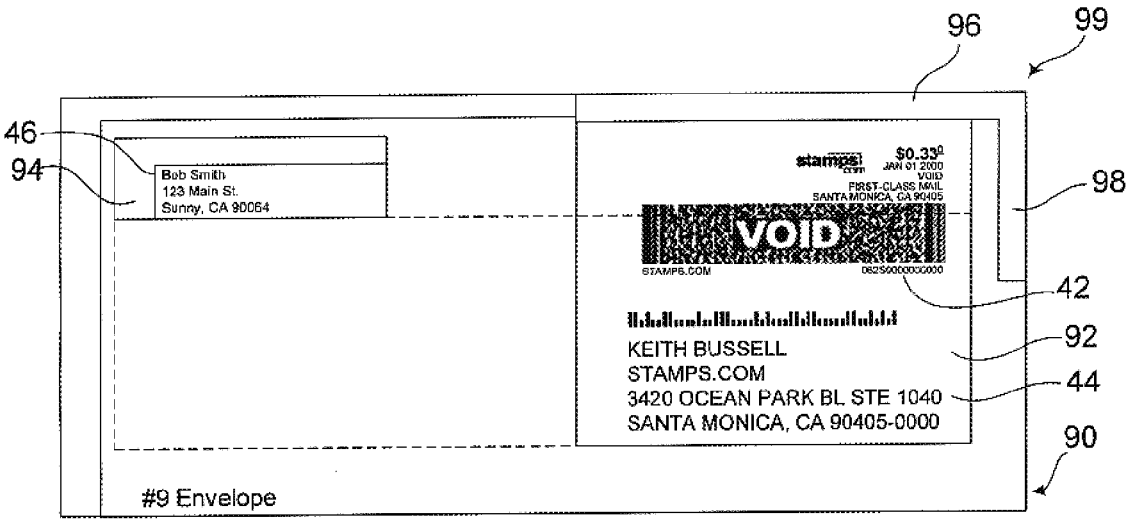
FIG. 10 is a plan view of the fluorescent windowed envelope of FIG. 9 with the insert of FIG. 3 placed therein and shifted to an lower right corner of the fluorescent windowed envelope.

FIG. 10 is a plan view of the fluorescent windowed envelope 90 with the insert 40 placed therein and shifted to an lower right corner of the fluorescent windowed envelope 90.

Figure 11:
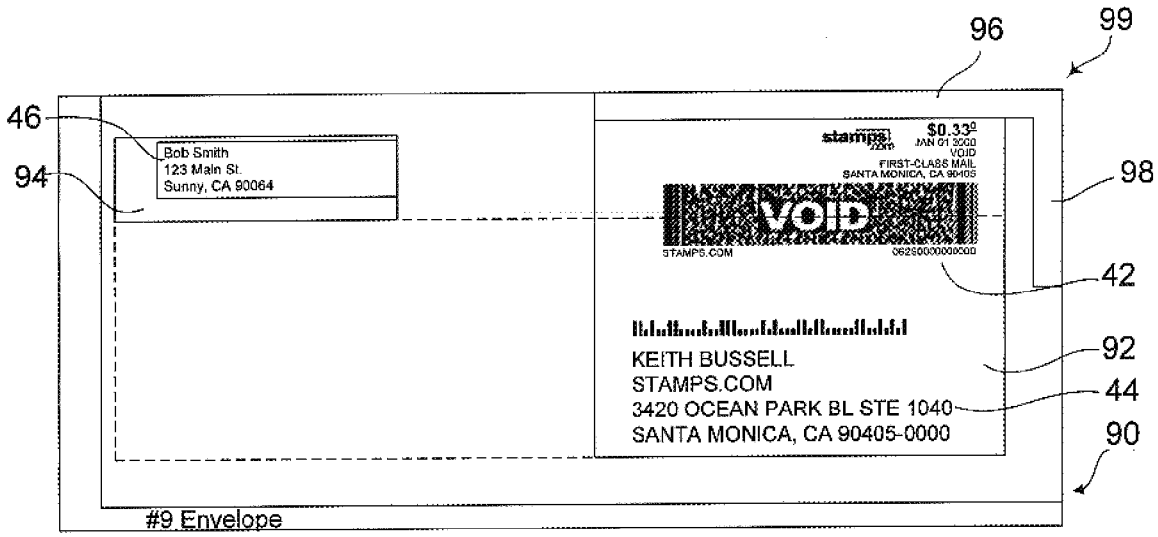
FIG. 11 is a plan view of the fluorescent windowed envelope of FIG. 9 with the insert of FIG. 3 placed therein and shifted to an upper right corner of the fluorescent windowed envelope.

FIG. 11 is a plan view of the fluorescent windowed envelope 90 with the insert 40 placed therein and shifted to an upper right corner of the fluorescent windowed envelope 90.

Figure 12:
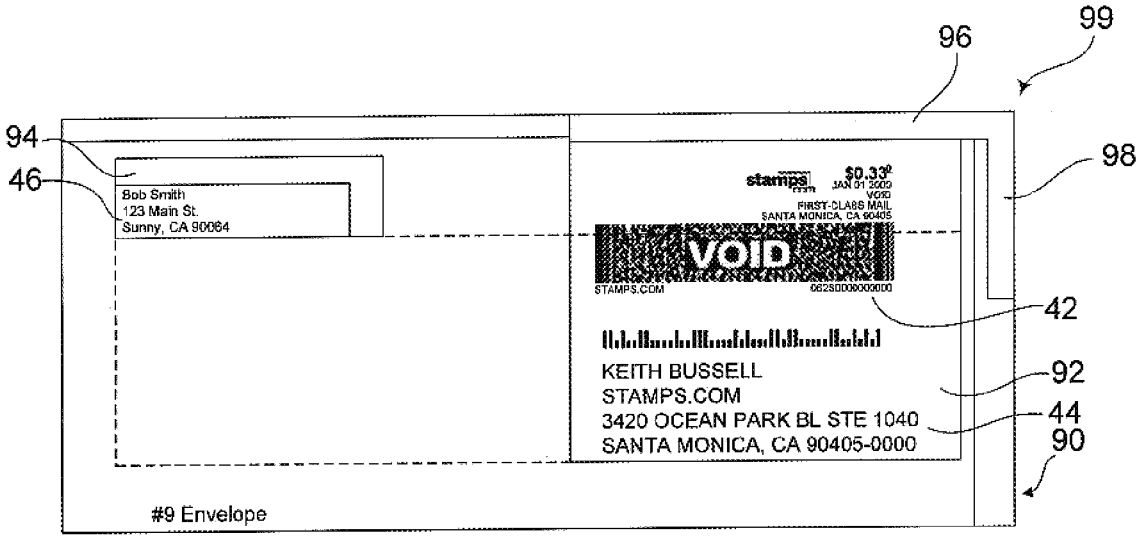
FIG. 12 is a plan view of the fluorescent windowed envelope of FIG. 9 with the insert of FIG. 3 placed therein and shifted to a lower left corner of the fluorescent windowed envelope.

FIG. 12 is a plan view of the fluorescent windowed envelope 90 with the insert of FIG. 3 placed therein and shifted to a lower left corner of the fluorescent windowed envelope 90.

Figure 13:
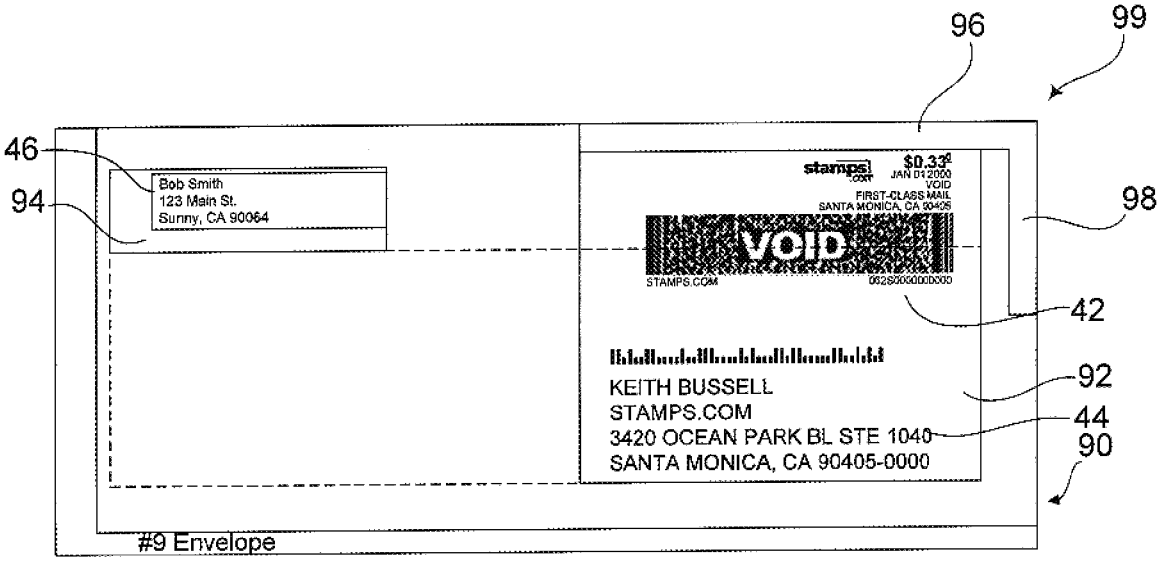
FIG. 13 is a plan view of the fluorescent windowed envelope of FIG. 9 with the insert of FIG. 3 placed therein and shifted to an upper left corner of the fluorescent windowed envelope.

FIG. 13 is a plan view of the fluorescent windowed envelope 90 with the insert of FIG. 3 placed therein and shifted to an upper left corner of the fluorescent windowed envelope 90.

As can be seen, even when the insert 40 is shifted within the fluorescent windowed envelope 90 to the maximum extent allowable, the address information 44 and postage indicia 42 and sender information 46 will remain fully revealed through the addressee/postage indicia window 52 and sender window 94.

Figure 14:
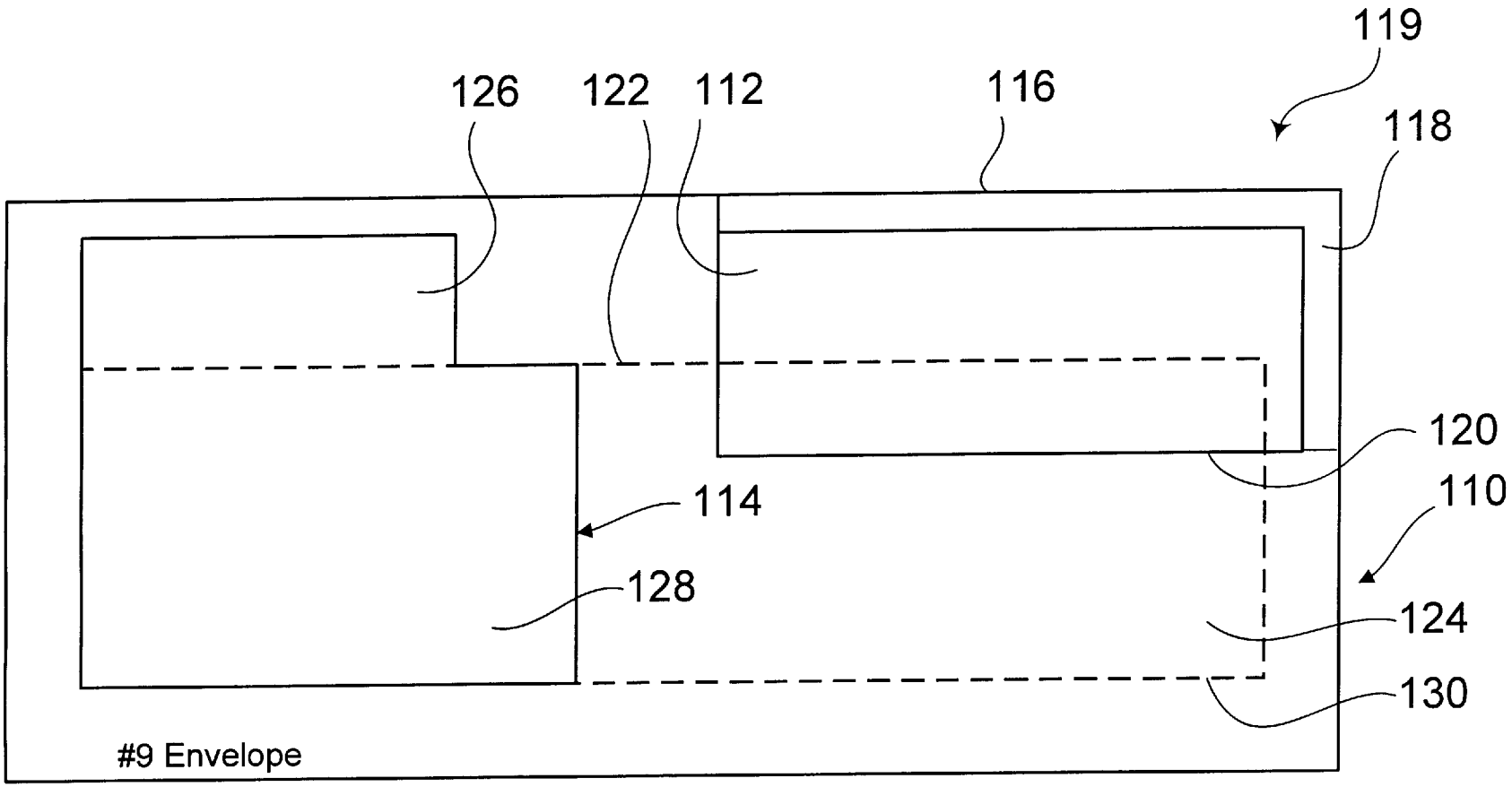
FIG. 14 is a plan view showing a third embodiment of an fluorescent stripe window envelope of the invention.

Referring to FIG. 14, there is shown a third embodiment of the fluorescent window stripe envelope 110 of the invention. It is sized as a size 9 envelope, and has an indicia window 112 and a combination addressee/sender winder 114. Indicia window is preferably about 9.84 cm (3.875 inches) wide and about 3.81 cm (1.5 inches) high, but other dimensions can be used as well. The fluorescent stripe window envelope 110 has solid fluorescent stripes 116 and 118 printed only on an upper top right edge and upper right hand, respectively, of the envelope, where the postage indicia window is located and together form a mirror-image of an L-shaped stripe layout 119 with the top stripe 116 being located at the upper right edge and the side stripe 118 being at the upper right hand side where the postage indicia window is located and serve as a replacement for an absent FIM pattern. The fluorescent stripes 116 and 118 are preferably about 0.635 cm (0.25 inch) wide, but other widths can be used as desired, so long as they are sufficiently wide to comply with postal service regulations. The fluorescent stripes 116 and 118 are shown as extending to the edges of the envelope, but could also be placed away form the edges of the envelope 110 is desired, and subject to postal service requirements. As shown, a lower edge 120 of the indicia window 112 extends below an upper edge 122 of the addressee scanning region 124 (shown by phantom lines.) The addressee/sender window 114 has an upper sender portion 126 and a lower addressee portion 128. The lower addressee portion 128 is sufficiently wide, e.g. about 8.41 cm (3.31 inches), and preferably extends from a bottom edge 130 of the addressee scanning region 124 to the top edge 122 of the addressee scanning region 124, which is a span of about 5.4 cm (2.125 inches.) The upper sender portion 126 can be made narrower than the lower addressee portion (having a width of about 7.62 cm or 2.5 inches) and have a height of about 2.22 cm (0.875 inches.) Alternatively, addressee/sender window 114 can have a rectangular shape.

Figure 15:
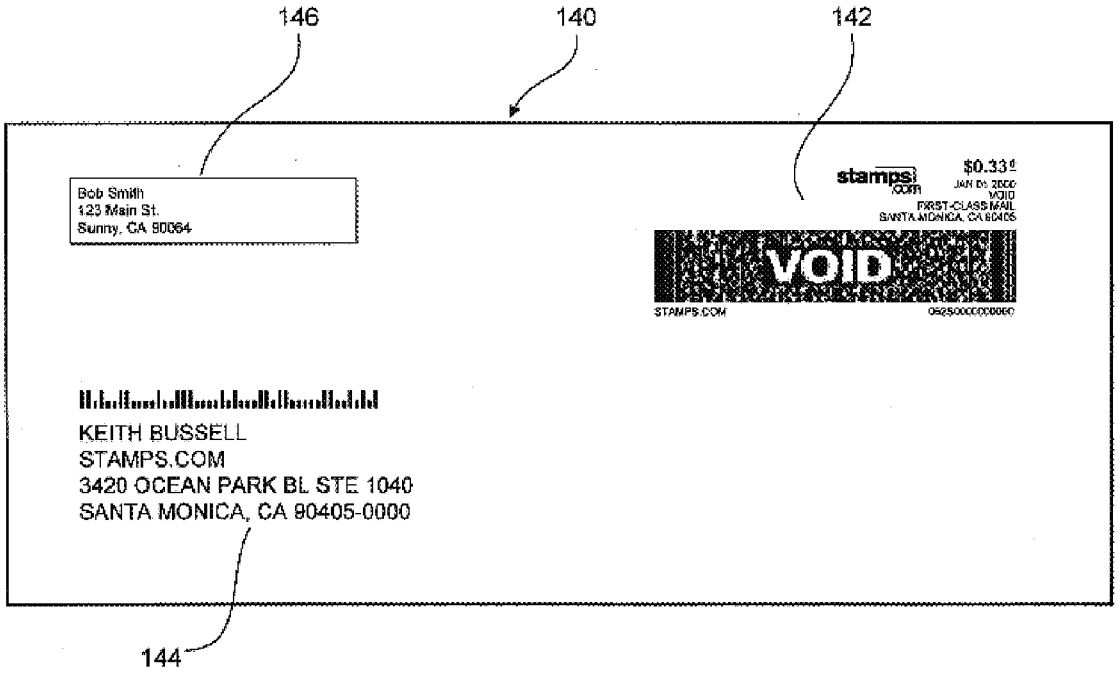
FIG. 15 is a plan view showing an insert for fluorescent windowed envelope of FIG. 14.

Referring to FIG. 15, there is shown an insert 140, which can comprise a sheet of standard U.S. letter sized sheet 21.59 cm×27.94 cm (8.5 inches×11 inches) paper folded into thirds, to assume a size of about 21.59 cm×9.31 cm (8.5 inches×3.67 inches.) The insert 140 is printed with the postal indicia 142 in an upper right hand corner thereof, the addressee information 144 in a lower left hand portion of the insert, and optionally with the sender information 146 in an upper left hand corner of the insert. No FIM pattern is printed on the insert 140.

Turning now to FIGS. 16 to 19, there is shown the insert 140 of FIG. 15 inserted into the fluorescent stripe window envelope 110 of FIG. 14, with the insert 140 variously shifted within the fluorescent stripe windowed envelope 110. The addressee scanning region 124 is shown in dashed lines. The fluorescent stripes 116 and 118 shown in the upper right hand corner of the envelope form the mirror-image of an L-shaped stripe layout 119.

Figure 16:
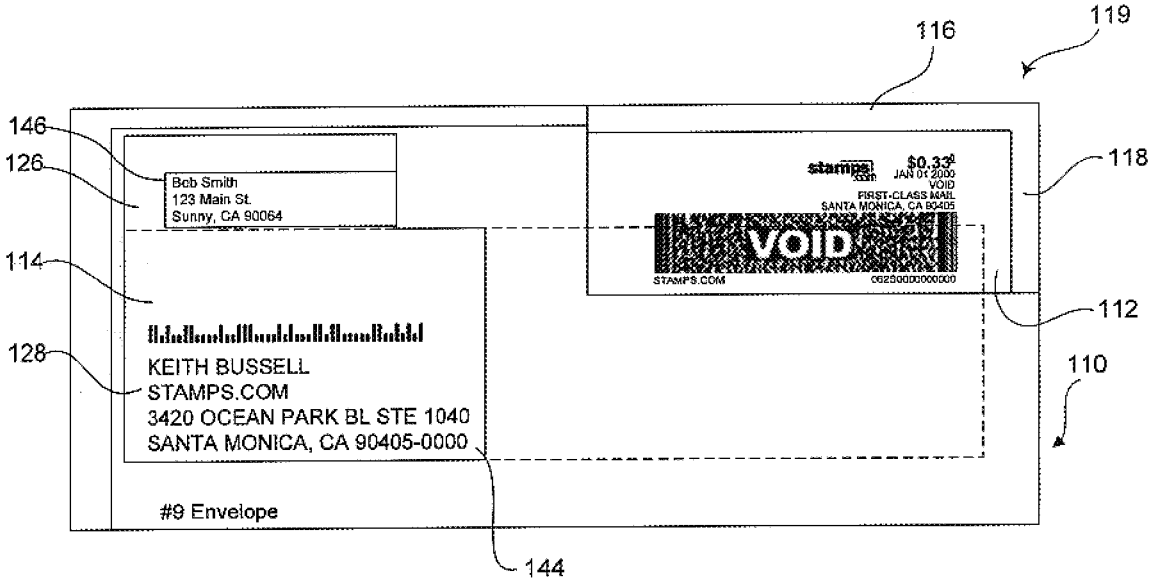
FIG. 16 is a plan view of the fluorescent windowed envelope of FIG. 15 with the insert of FIG. 15 placed therein and shifted to an lower right corner of the fluorescent windowed envelope.

FIG. 16 is a plan view of the fluorescent windowed envelope 110 with the insert 140 of FIG. 15 placed therein and shifted to an lower right corner of the fluorescent windowed envelope 110.

Figure 17:
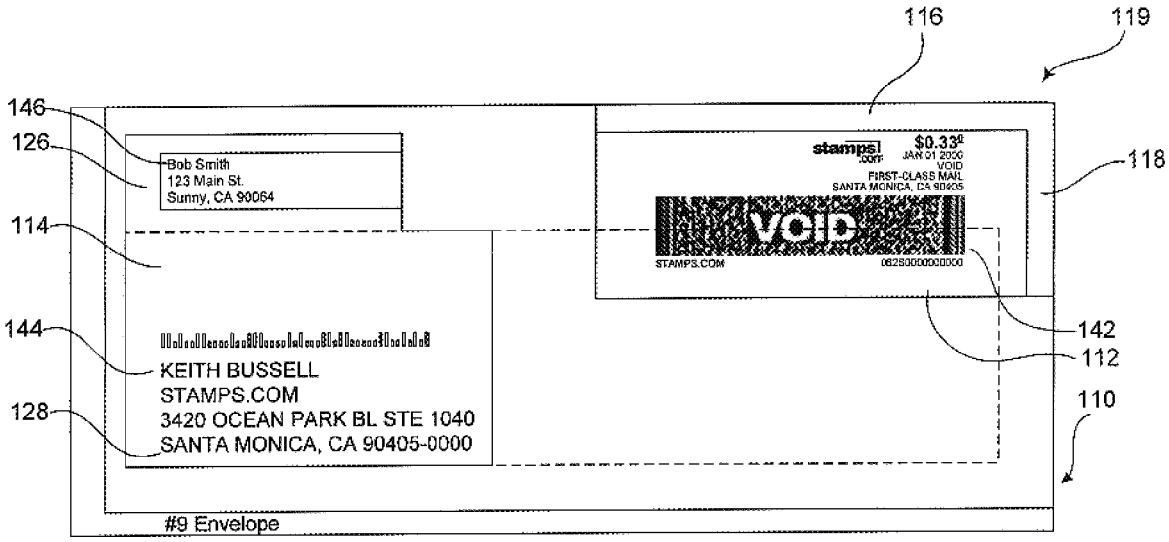
FIG. 17 is a plan view of the fluorescent windowed envelope of FIG. 14 with the insert of FIG. 15 placed therein and shifted to an upper right corner of the fluorescent windowed envelope.

FIG. 17 is a plan view of the fluorescent windowed envelope 110 with the insert 140 of FIG. 15 placed therein and shifted to an upper right corner of the fluorescent windowed envelope 110.

Figure 18:
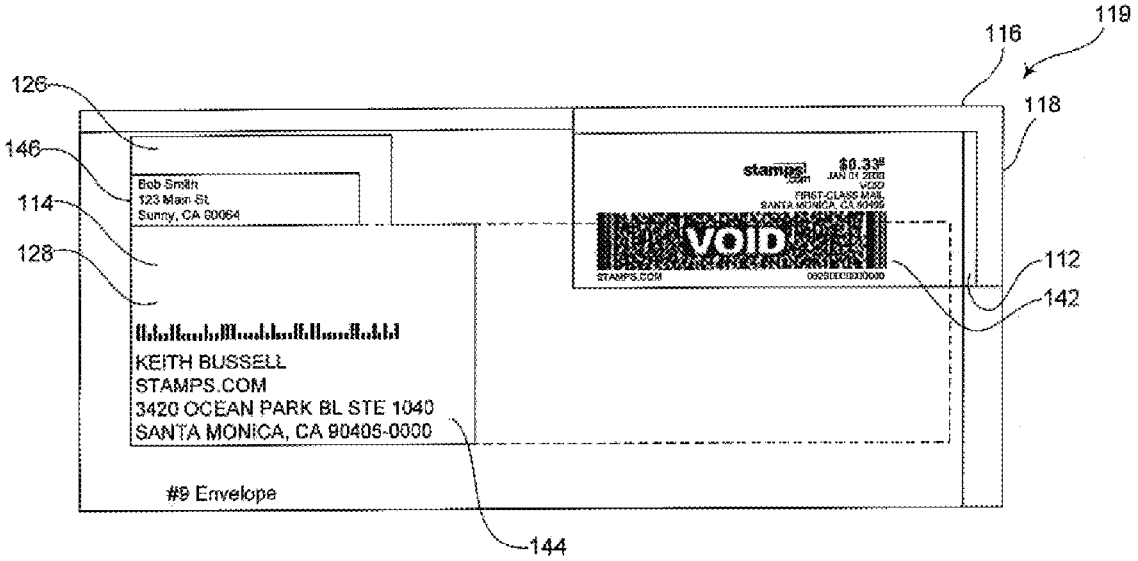
FIG. 18 is a plan view of the fluorescent windowed envelope of FIG. 14 with the insert of FIG. 15 placed therein and shifted to a lower left corner of the fluorescent windowed envelope.

FIG. 18 is a plan view of the fluorescent windowed envelope 110 with the insert 140 of FIG. 15 placed therein and shifted to a lower left corner of the fluorescent windowed envelope 110.

Figure 19:
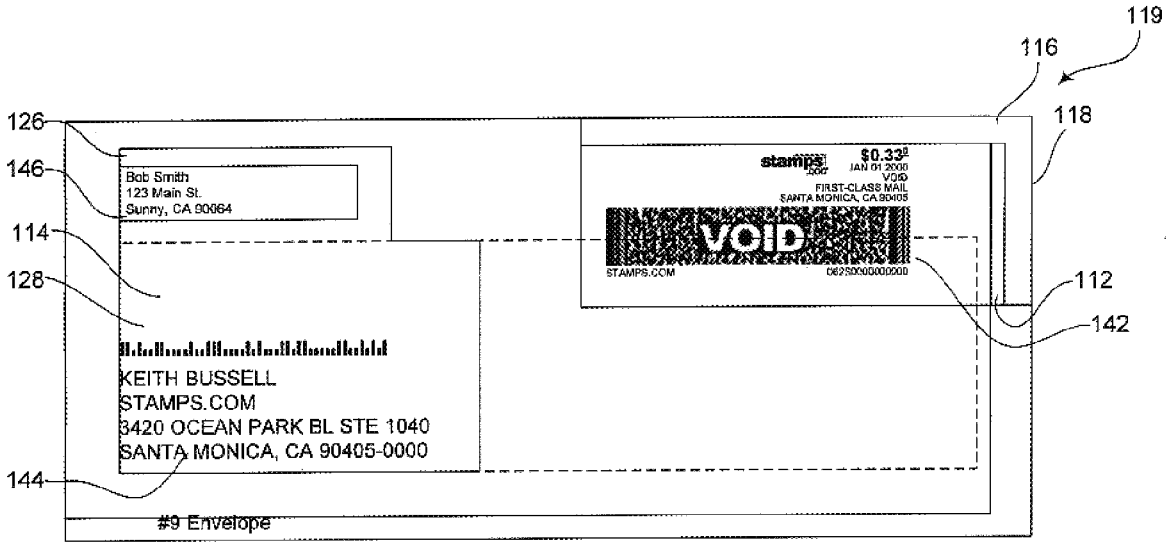
FIG. 19 is a plan view of the fluorescent windowed envelope of FIG. 14 with the insert of FIG. 15 placed therein and shifted to an upper left corner of the fluorescent windowed envelope.

FIG. 19 is a plan view of the fluorescent windowed envelope 110 with the insert of FIG. 15 placed therein and shifted to an upper left corner of the fluorescent windowed envelope 10.

Regardless of the particular embodiment of fluorescent stripe windowed envelope described above, the inserts 40 and 140 can be printed by the user onto standard letter sized paper, folded into general thirds (without any need for excessive precision), and inserted into the fluorescent stripe windowed envelopes 50, 90, and 140, and have a great degree of assurance that the mailpiece will be automatically processed without any glitches. The designs of the fluorescent stripe windowed envelope take into account possible skew introduced by sheets not being folded into perfect thirds and with their corners not be lined up properly. The postal indicia 142, the addressee information 144, and the sender information 146 printed on the insert 140 are of predetermined size and position ranges to allow for less than perfect folding of the inserts 40 and 140 and to account for possible shifting of the inserts 40 and 140 in the fluorescent stripe envelope 50, 90 and 110. The various sizes and positions of the postal indicia 42, the addressee information 44, and the sender information 46 to be printed on the insert 40 and the postal indicia 142, the addressee information 144, and the sender information 146 to be printed on the insert 140 can be conveniently provided as part of the computer software used to print the inserts 40 and 140.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation.

What is claimed is:

1. A fluorescent stripe window envelope for use with PC postage, comprising:

an envelope having a front wall and a rear wall, a top edge, a bottom edge, a right edge and a left edge, the envelope having a postage indicia window formed in the front wall in an upper right hand region of the envelope;

a top solid fluorescent stripe located on the right side top edge of the envelope; and a side solid fluorescent stripe located on the upper right side edge of the envelope, wherein the top and side stripes only extend around the edges of the envelope where the postage indicia window is located, and wherein the top and side solid fluorescent strips together form a mirror-image of an L-shaped stripe layout.

2. The fluorescent stripe window envelope of claim 1, wherein the postage indicia window is rectangular and extends to the top fluorescent stripe located on the right side top edge of the envelope.

3. The fluorescent stripe window envelope of claim 1, wherein the envelope has a standard business envelope size to accommodate at least three tri-folded sheets of standard sized letter paper sheets or a standard business courtesy envelope.

4. The fluorescent stripe window envelope of claim 1, wherein the envelope has the same size as a standard size 10 envelope.

5. The fluorescent stripe window envelope of claim 1, wherein the envelope has a standard business envelope size to accommodate at least three tri-folded sheets of standard sized letter paper sheets or a standard business courtesy envelope as inserts, such that when the insert is inserted into the envelope there is less than about a 5% horizontal skew of the insert relative to the envelope.

6. The fluorescent stripe window envelope of claim 1, wherein the postage indicia window has a lower edge which extends to or below an addressee scanning region of the envelope, a right edge which extends to or to the right of the addressee scanning region, and an upper edge that extends to or above the upper edge of the addressee scanning region.

7. The fluorescent stripe window envelope of claim 1, wherein the envelope does not have any FIM pattern printed on the envelope.

8. The fluorescent stripe window envelope of claim 1, further comprising a sender display window formed adjacent to the upper left hand side of the envelope.

9. The fluorescent stripe window envelope of claim 8, wherein the sender display window is rectangular.

10. The fluorescent stripe window envelope of claim 8, wherein the sender display window has a smaller upper rectangular portion for sender information and a larger lower rectangular portion for addressee information, the lower rectangular portion having a lower edge which extends to or below an addressee scanning region of the envelope, and an upper edge that extends to or above the upper edge of the addressee scanning region.

11. The fluorescent stripe window envelope of claim 1, wherein the fluorescent stripes are at least about 0.635 cm wide.

12. The fluorescent stripe window envelope of claim 1, wherein the fluorescent stripes are printed onto the envelope.

13. The fluorescent stripe window envelope of claim 1, wherein the postage indicia window is a plastic window.

14. The fluorescent stripe window envelope of claim 13, wherein the envelope has the same size as a standard size 10 envelope.

15. The fluorescent stripe window envelope of claim 13, wherein the postage indicia window has a lower edge which extends to or below an addressee scanning region of the envelope, a right edge which extends to or to the right of the addressee scanning region, and an upper edge that extends to or above the upper edge of the addressee scanning region.

16. The fluorescent stripe window envelope of claim 15, wherein the sender display window is rectangular.

17. The fluorescent stripe window envelope of claim 15, wherein the sender display window has a smaller upper rectangular portion for sender information and a larger lower rectangular portion for addressee information, the lower rectangular portion having a lower edge which extends to or below an addressee scanning region of the envelope, and an upper edge that extends to or above the upper edge of the addressee scanning region.

18. The fluorescent stripe window envelope of claim 13, further comprising a sender display window formed adjacent to the upper left hand side of the envelope.

19. A fluorescent stripe window envelope for use with PC postage, comprising:

a standard sized business envelope having a front wall and a rear wall, a top edge, a bottom edge, a right edge and a left edge, the envelope having a postage indicia window formed in the front wall in an upper right hand region of the envelope to expose postage indicia, the envelope sized to accommodate at least three tri-folded sheets of standard sized letter paper sheets or a standard business courtesy envelope as inserts such that when the insert is inserted into the envelope there is less than about a 5% horizontal skew of the insert relative to the envelope, the envelope being free of FIM marks;

a top solid fluorescent stripe located on the right side top edge of the envelope; and a side solid fluorescent stripe located on the upper right side edge of the envelope, wherein the top and side stripes only extend around the edges of the envelope where the postage indicia window is located, and wherein the top and side solid fluorescent strips together form a mirror-image of an L-shaped stripe layout.

* * * * *

UNITED STATES PATENT AND TRADEMARK OFFICE

CERTIFICATE OF CORRECTION

PATENT NO. : 6,692,033 B2
APPLICATION NO. : 09/811006
DATED : February 17, 2004
INVENTOR(S) : Miller et al.

It is certified that error appears in the above-identified patent and that said Letters Patent is hereby corrected as shown below:

On the Title Page

| | |
|---|---|
| (75) Inventors<br>Christopher P. Miller | Delete "Alison Viejo",<br>Insert --Aliso Viejo-- |
| Column 9, line 7, Claim 1 | Delete "strip",<br>Insert --stripes-- |
| Column 10, line 46, Claim 19 | Delete "strips",<br>Insert --stripes-- |

Signed and Sealed this

Eighth Day of August, 2006

JON W. DUDAS
*Director of the United States Patent and Trademark Office*